US008827005B2

(12) United States Patent
Morley et al.

(10) Patent No.: US 8,827,005 B2
(45) Date of Patent: Sep. 9, 2014

(54) METHOD FOR DRILLING WELLS IN CLOSE RELATIONSHIP USING MAGNETIC RANGING WHILE DRILLING

(75) Inventors: Jan S. Morley, Houston, TX (US); Brian Clark, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 580 days.

(21) Appl. No.: 12/105,067

(22) Filed: Apr. 17, 2008

(65) Prior Publication Data

US 2009/0260878 A1 Oct. 22, 2009

(51) Int. Cl.

| | |
|---|---|
| ***E21B 7/04*** | (2006.01) |
| ***E21B 47/09*** | (2012.01) |
| ***E21B 47/022*** | (2012.01) |
| ***E21B 43/30*** | (2006.01) |

(52) U.S. Cl.

CPC ..... *E21B 47/0905* (2013.01); *E21B 47/02216* (2013.01); *E21B 43/305* (2013.01)

USPC ..... 175/24; 175/45

(58) Field of Classification Search

USPC ..... 33/302, 304, 310, 313, 355 R; 175/45, 175/61, 62; 166/66.5, 65.1; 324/326, 346, 324/352, 356, 345, 369, 340

See application file for complete search history.

(56) References Cited

U.S. PATENT DOCUMENTS

| | | | | |
|---|---|---|---|---|
| 4,323,848 | A | | 4/1982 | Kuckes |
| 4,372,398 | A | | 2/1983 | Kuckes |
| 4,443,762 | A | | 4/1984 | Kuckes |
| 4,529,939 | A | | 7/1985 | Kuckes |
| 4,593,770 | A | * | 6/1986 | Hoehn, Jr. ..... 175/45 |
| 4,700,142 | A | | 10/1987 | Kuckes |
| 4,791,373 | A | | 12/1988 | Kuckes |
| 4,845,434 | A | | 7/1989 | Kuckes |
| 4,933,640 | A | | 6/1990 | Kuckes |
| 4,957,172 | A | | 9/1990 | Patton |
| 5,074,365 | A | | 12/1991 | Kuckes |
| 5,131,477 | A | | 7/1992 | Stagg |
| 5,218,301 | A | | 6/1993 | Kuckes |
| 5,258,755 | A | | 11/1993 | Kuckes |
| 5,305,212 | A | | 4/1994 | Kuckes |
| 5,323,856 | A | | 6/1994 | Davis |
| 5,343,152 | A | | 8/1994 | Kuckes |
| 5,485,089 | A | | 1/1996 | Kuckes |

(Continued)

FOREIGN PATENT DOCUMENTS

| | | | |
|---|---|---|---|
| GB | 2441033 A | * | 2/2008 |
| WO | 2006053434 A1 | | 5/2006 |

OTHER PUBLICATIONS

W H Press et al., Numerical Recipes in C The Art of Scientific Computing, 2d ed., Ch. 15.6 Confidence Limits on Estimated Model Parameters, Cambridge Univ. Press, pp. 689-699 (1992).

U.S. Appl. No. 60/882,598, filed Aug. 16, 2006, Clark et al.

(Continued)

*Primary Examiner* — James Sayre

(74) *Attorney, Agent, or Firm* — Kimberly Ballew

(57) ABSTRACT

Methods for drilling wells using magnetic ranging while drilling to position the wells with respect to one another are provided. In accordance with one embodiment, a method of drilling a well includes leaving a drill string in position within a primary well, and drilling a secondary well using the drill string as a target for magnetic ranging while drilling such that the secondary well is positioned with a specified orientation relative to the drill string.

6 Claims, 5 Drawing Sheets

(56) References Cited

U.S. PATENT DOCUMENTS

| | | | | |
|---|---|---|---|---|
| 5,512,830 | A * | 4/1996 | Kuckes | 324/346 |
| 5,513,710 | A | 5/1996 | Kuckes | |
| 5,515,931 | A | 5/1996 | Kuckes | |
| 5,589,775 | A | 12/1996 | Kuckes | |
| 5,657,826 | A | 8/1997 | Kuckes | |
| 5,676,212 | A | 10/1997 | Kuckes | |
| 5,725,059 | A | 3/1998 | Kuckes et al. | |
| 5,923,170 | A | 7/1999 | Kuckes | |
| 5,960,370 | A | 9/1999 | Towle et al. | |
| 6,736,222 | B2 | 5/2004 | Kuckes et al. | |
| 2002/0130663 | A1 | 9/2002 | Kuckes | |
| 2003/0085059 | A1 | 5/2003 | Kuckes et al. | |
| 2003/0188891 | A1 | 10/2003 | Kuckes | |
| 2004/0040745 | A1 | 3/2004 | Kuckes | |
| 2004/0206510 | A1 * | 10/2004 | Fraser et al. | 166/378 |
| 2005/0211469 | A1 | 9/2005 | Kuckes et al. | |
| 2006/0065441 | A1 | 3/2006 | Kuckes | |
| 2006/0066454 | A1 | 3/2006 | Kuckes et al. | |
| 2006/0053434 | A1 | 5/2006 | Halliburton | |
| 2006/0113112 | A1 * | 6/2006 | Waters | 175/61 |
| 2007/0126426 | A1 | 6/2007 | Clark et al. | |
| 2008/0041626 | A1 * | 2/2008 | Clark | 175/45 |
| 2009/0178850 | A1 * | 7/2009 | Waters et al. | 175/45 |

OTHER PUBLICATIONS

U.S. Appl. No. 11/781,704, filed Jul. 23, 2007, Clark.

U.S. Appl. No. 11/833,032, filed Aug. 2, 2007, Clark et al.

J.E. Walstrom, et al.; "An analysis of Uncertainty in Directional Surveying"; *Journal of Petroleum Technology*, Apr. 1969; pp. 515-523.

H. S. Williamson, "Accuracy Prediction for Directional Measurement While Drilling"; *SPE Drilling and Completion*, vol. 15, No. 4; Dec. 2000; pp. 221-233.

C.J.M. Wolff, et al.; "Borehole Position Uncertainty—Analysis of Measuring Methods and Derivation of Systematic Error Model"; *Journal of Petroleum Technology*, Dec. 1981; pp. 2330-2350.

* cited by examiner

METHOD FOR DRILLING WELLS IN CLOSE RELATIONSHIP USING MAGNETIC RANGING WHILE DRILLING

FIELD OF THE INVENTION

The present invention relates generally to well drilling operations and, more particularly, to well drilling operations using magnetic ranging to drill wells in specified orientations with respect one another, wherein the wells may include wells to be completed open hole and/or wells to be completed with equipment disposed therein and hindering access to the wellbore.

BACKGROUND OF THE INVENTION

It is often desirable to position wells close together. For example, in certain oilfield applications, drilling wells close together may facilitate extraction of heavy oil. Indeed, heavy oil is generally too viscous in its natural state to be produced from a conventional well. Accordingly, to produce heavy oil, multiple wells, such as a pair of Steam Assisted Gravity Drainage (SAGD) wells, may be employed. A SAGD well pair typically includes two substantially parallel horizontal wells that are positioned relatively close together in a stacked orientation, and that use superheated steam to heat heavy oil until its viscosity is low enough to be produced. The upper well in a SAGD well pair may be referred to as an injector well. The lower well in a SAGD well pair may be referred to as a producer well. In operation, the injector well typically injects superheated steam into a heavy oil zone formation, creating a steam chamber to heat the heavy oil contained therewithin. When the heated heavy oil becomes less viscous, gravity pulls the oil into the producer well, which facilitates extraction of the oil.

When wells are drilled close to one another, there are typically spacing requirements that are essentially impossible to meet using conventional surveying techniques. For example, in a SAGD well pair, it may be desirable for the injector well and the producer well to be drilled such that they maintain a target separation distance, such as an approximately constant vertical separation distance (e.g., 4 to 6 m) over a horizontal distance (e.g., 500 m to 1500 m). Conventional measurement while drilling (MWD) survey data, which may only include inclination and azimuth data, does not provide sufficient accuracy to maintain a consistent separation distance between the injector well and the producer well. Accordingly, conventional spacing techniques may employ conventional magnetic ranging to facilitate drilling two or more wells within a specified distance from each other. For example, such conventional magnetic ranging techniques may be utilized to drill the second of the two wells of a SAGD well pair in an appropriate location with respect to the first well.

Conventional magnetic ranging techniques involve placing wireline equipment in a first well while a second well is drilled a specified distance from the first well. In operation, a magnetic field between the wireline equipment in the first well and a drilling bottom hole assembly (BHA) in the second well may enable the BHA in the second well to maintain an accurate vertical separation distance between the first and second wells of the SAGD pair. For example, the wireline equipment may include a solenoid configured to generate a known magnetic field, as is done with a Magnetic Guidance Tool (MGT), and the field may be detected to facilitate guiding the BHA. In another example, a wireline magnetometer may be used to measure a magnetic field generated by permanent magnets in the BHA of the second well, as is done with Rotating Magnet Ranging (RMR) systems, to facilitate guiding the BHA. However, when the wells are horizontal, these conventional magnetic ranging techniques require a wireline tractor to push the wireline tool down the length of the first horizontal well as the second well is being drilled. This can be an expensive procedure in a typical cased-hole tractor operation. Further, such a procedure may be even more difficult, expensive, and risky for an openhole tractor operation.

SUMMARY

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with one embodiment, a method of drilling a well includes leaving a drill string in position within a primary well, and drilling a secondary well using the drill string as a target for magnetic ranging while drilling such that the secondary well is positioned with a specified orientation relative to the drill string.

BRIEF DESCRIPTION OF THE DRAWINGS

Advantages of embodiments of the invention may become apparent upon reading the following detailed description and upon reference to the drawings in which.

DETAILED DESCRIPTION OF SPECIFIC EMBODIMENTS

Figure 1:
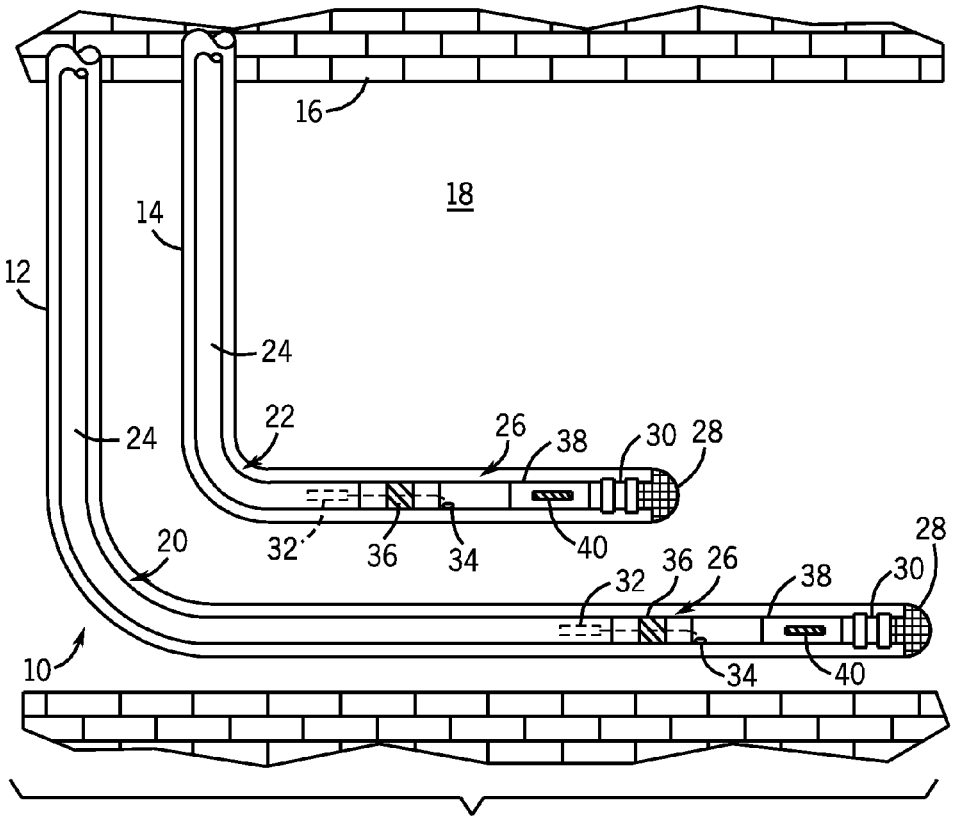
FIG. 1 is a schematic diagram depicting a well drilling operation in accordance with one embodiment of the invention.

One or more specific embodiments of the present invention are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In well drilling operations, it may be desirable to place wells close together or in specific orientations relative to one another. Indeed, in SAGD operations, for example, well pairs are generally positioned parallel and close together to facilitate production of heavy oil. Additionally, it may be desirable in other drilling operations to position a series of wells in a specific orientation relative to one another. For example, it may be desirable to drill a number of parallel wells in a row. Well drilling operations, such as SAGD operations and the like, typically have a criterion for spacing that requires the use of some type of ranging technique, other than conventional MWD surveying techniques that only report inclination and azimuth, to establish orientations and distances between the wells. It is now recognized that the ability to perform such ranging techniques may become an issue when a well is completed openhole or with equipment positioned in the well that prevents wireline equipment from accessing the well.

Embodiments of the present invention are directed to systems and methods for drilling two or more wells while maintaining a positional relationship between the wells, such as a specific angular orientation of less than 90 degrees or a distance of a few meters between the walls of each well. In particular, present embodiments are directed to drilling two or more respectively positioned wells that are to be completed openhole (i.e., without casing or liner), or that are to be completed with equipment positioned therein that prevents other equipment from being present in the wellbore. With regard to openhole completions, present embodiments may avoid difficulties associated with properly positioning wireline equipment within a well that does not include casing. For example, by providing a magnetic ranging technique that avoids the use of wireline equipment, present embodiments may avoid undesirable operations that may involve the use of wireline tractors in horizontal, openhole wells. Further, with regard to wells completed with equipment disposed therein, present embodiments may avoid accessibility issues associated with such wells. For example, heating elements (e.g., electrical wires or resistive elements) disposed in a completed well may prevent wireline equipment, such as a wireline tractor, from accessing the wellbore. Present embodiments may avoid such accessibility issues by facilitating magnetic ranging while drilling without requiring the positioning of a wireline specifically for ranging purposes in the wellbore.

FIG. 1 depicts a well drilling operation 10 involving drilling a pair of parallel wells using a magnetic ranging while drilling technique in accordance with present embodiments. While FIG. 1 specifically depicts parallel wells, which would typically be utilized in a SAGD application, one of ordinary skill in the art will recognize that present embodiments may apply to various positional relationships, such as maintaining a specified angular relationship (e.g., a non-perpendicular angular orientation) between wells.

The technique referred to as "magnetic ranging while drilling" relates to drilling two or more wells in positions or orientations relative to one another in accordance with present embodiments. Specifically, magnetic ranging while drilling facilitates drilling a well in a specific orientation with respect to a previously drilled well without requiring the use of a wireline tool specifically designed for such a purpose. Though an overview of magnetic ranging while drilling is discussed below, a detailed description of magnetic ranging while drilling is available in published application US 2007/012426 A1, which is incorporated herein by reference.

Turning to the specific features illustrated in FIG. 1, the well drilling operation 10 is illustrated as including a first well 12 and a second well 14 positioned parallel to one another in a formation 16, which includes a heavy oil zone formation 18. The first well 12 and the second well 14 may cooperate to provide a SAGD well pair that may facilitate recovery of oil from the heavy oil zone formation 18. As a SAGD well pair, the first well 12 operates as an injector well and the second well 14 operates as a producer well. In other words, in operation, the first well 12 may inject superheated steam into the heavy oil zone formation 18 to heat the heavy oil and make it less viscous, which may enable gravity to pull the oil into the second well 14 for production.

In accordance with one embodiment of the invention, either the first well 12 or the second well 14 is initially drilled and the well drilled subsequently is positioned based on the existing well. For example, the first well 12 may be drilled first, and present embodiments may facilitate drilling the second well 14 in a controlled orientation relative to the first well 12. In some embodiments, multiple wells may be drilled simultaneously with one well acting as the guide. For example, once a portion of the first well 12 has been drilled, the second well 14 may be drilled relative to the position of the first well 12.

Figure 7:
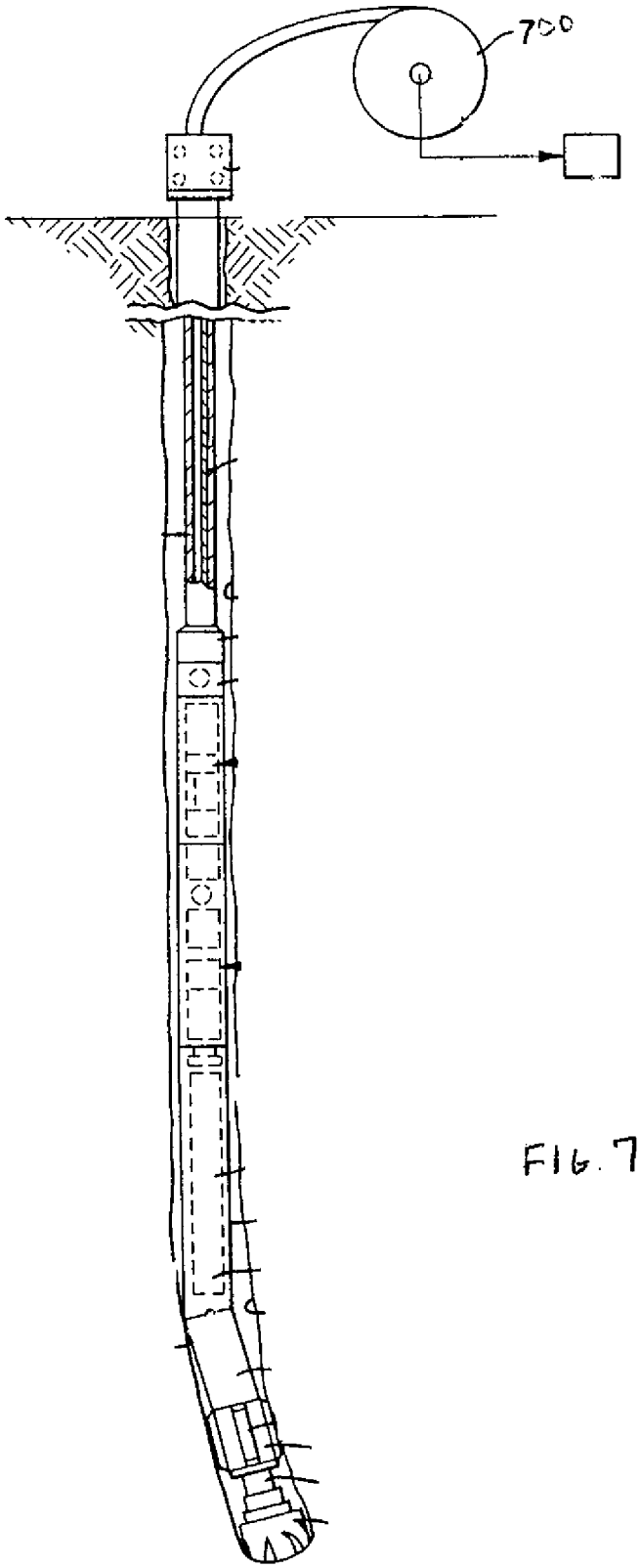
FIG. 7 illustrates a coiled tubing unit that may be utilized in an embodiment of the present invention.

As illustrated in FIG. 1, the first well 12 may be drilled using a first set of drilling equipment 20, and the second well 14 may be drilled using a second set of drilling equipment 22. Each set of drilling equipment, which may also be referred to as drill string, may include drill pipe 24 having a bottom hole assembly (BHA) 26. As will be discussed in further detail below, separate sets of drilling equipment may be utilized for drilling each of the first and second wells 12, 14 to facilitate relative positioning of the wells 12, 14 in accordance with present embodiments. Separate drilling rigs may also be utilized. However, to facilitate costs savings, a single drilling rig may be utilized to drill both wells. Accordingly, it may be desirable to disconnect the drill string 20 utilized in the first well 12 from the drilling rig and to skid the drilling rig to drill the second well 14. If the drill string 20 includes drill pipe, the drill pipe may simply be unscrewed from the Kelly of the drilling rig. If the drill string includes coiled tubing, a preinstalled joint in the coiled tubing may facilitate disconnecting the drill string 20 from a coiled tubing unit 700, as shown in FIG. 7.

In the illustrated embodiment, the BHA 26 for each set of drilling equipment 20, 22 is equipped to perform magnetic ranging while drilling. In other embodiments only one of the sets of drilling equipment 20, 22 (the set for the subsequently drilled well) may be configured to perform magnetic ranging while drilling. Specifically, in the illustrated embodiment, the BHA 26 includes a drill bit 28 for drilling through the formation 16 and a steerable system 30 to set the direction of the drill bit 28. Further, the BHA 26 includes an electric current driving tool 32, which may be a component of a measurement while drilling (MWD) tool or a standalone tool, such as Schlumberger's E-Pulse or E-Pulse Express tool. The electric current driving tool 32 provides an electric current to an outer drill collar 34 of the BHA 26. The outer drill collar 34 is separated from the rest of the drill pipe 24 by an insulated gap 36 in the drill collar, through which electric current may not pass. The BHA 26 additionally includes a magnetometer tool 38 having a three-axis magnetometer 40. The three-axis magnetometer 40 plays an integral role in the technique known as magnetic ranging while drilling. It should be noted that the BHA 26 may also include logging while drilling (LWD) tools, telemetry tools, and/or other downhole tools for use in a drilling environment.

As depicted in FIG. 1, the first well 12 may be completed openhole. In other words, the first well 12 may be completed without casing. Typically, wells are cased immediately after they are drilled due to wellbore instability that may cause the well to cave-in and prevent production from the well. However, in highly competent formations, such as carbonate formations, casing may not be required, which can save considerable time and expense associated the installing the casing.

If the first well 12 were completed with casing, the casing could be utilized to produce a magnetic field as part of performing the magnetic ranging while drilling technique, as discussed in published application US 2007/012426 A1. However, because the first well 12 has been completed openhole, there is no conductive casing in the first well 12 to utilize as a guide for drilling the second well 14. Nevertheless, magnetic ranging while drilling may still be utilized to position the second well 14 with respect to the first well 12 in accordance with present embodiments. Indeed, assuming that the formation 16 is sufficiently strong, as is usually true for openhole completions, equipment may be left in the wellbore of the first well 12 for a time without the risk of the formation collapsing and trapping the equipment. Therefore, in accordance with present embodiments, the drill string 20 may be left in the first well 12 for a time after drilling the first well 12. While leaving equipment in the first well 12 for a prolonged period may require careful monitoring of the formation and proper mud weight, it may be left in position while the second well 14 is drilled. Thus, the drill string 20, which could include drill pipe or coiled tubing, may be utilized to provide a highly conductive target for electrical current. Indeed, the drill string 20 left in the first well 12 may provide a good target for magnetic ranging while drilling to facilitate drilling the second well 14 in a position relative to the position of the first well 12.

Figure 2:
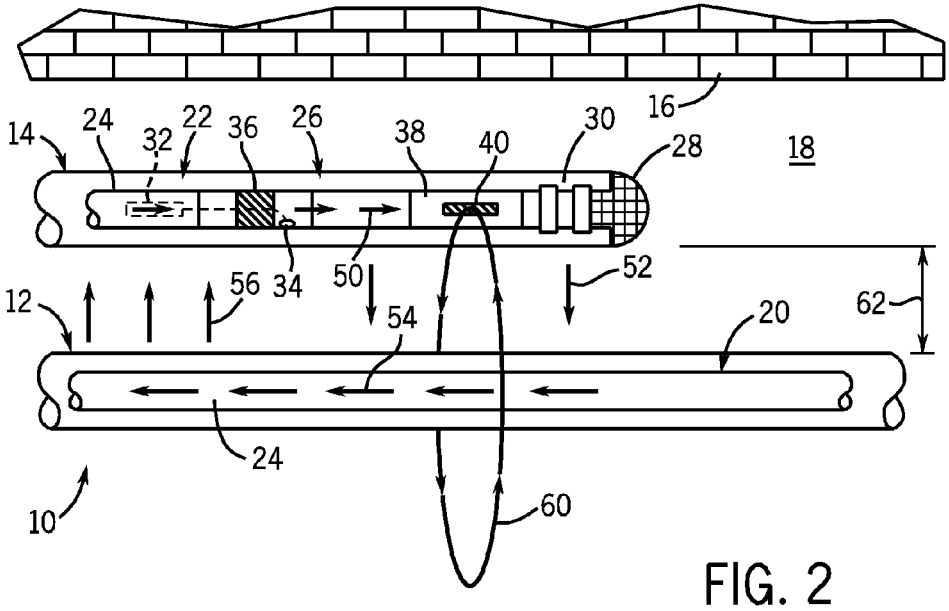
FIG. 2 is a schematic diagram illustrating the use of magnetic ranging while drilling in the well drilling operation of FIG. 1.

Present embodiments involve drilling an initial well (e.g., the first well 12) to a desired or target depth, and then leaving the drill string (e.g., the drill string 20) utilized to drill the initial well in place while one or more additional wells (e.g., the second well 14) are drilled relative to the initial well using magnetic ranging while drilling. Turning to FIG. 2, a schematic of a specific portion of the well drilling operation 10 illustrates the use of magnetic ranging while drilling to drill the second well 14 at an approximately constant vertical separation distance from the first well 12. Without need for a separate wireline tool, magnetic ranging while drilling allows the BHA 26 to maintain a precise distance from the previously drilled first well 12. More specifically, magnetic ranging while drilling allows the BHA 26 to maintain a precise distance from the drill string 20 still residing in the first well 12.

To ascertain a vertical separation distance from the first well 12 using magnetic ranging while drilling, the electric current driving tool 32 first provides an electric current 50 to the outer drill collar 34. The current 50 produced by the electric current driving tool 32 may, for example, have a frequency between about 1 Hz and about 100 Hz, and may have an amplitude of around 17 amps. Beginning along the outer drill collar 34 of the BHA 26, the current 50 may subsequently enter the heavy oil zone formation 18. The portion of the current 50 that enters the heavy oil zone formation 18 is depicted as an electric current 52.

The drill string 20 positioned in the first well 12 (typically along with drilling mud) provides very low resistance to electricity as compared to the heavy oil zone formation 18, being typically six orders of magnitude lower than the resistance of the heavy oil zone formation 18. As a result, a substantial portion of the current 52 will pass along the drill string 20, depicted as a current 54, rather than travel elsewhere through the heavy oil zone formation 18. The current 54 travels along the drill string 20 before re-entering the heavy oil zone formation 18 as current 56 on its way toward completing the circuit beginning at the electric current driving tool 32, located on the opposite side of the insulated gap 36 from the start of current 50.

The movement of the current 54 along the drill string 20 creates a magnetic field 60, an azimuthal magnetic field centered on the drill string 20. The three-axis magnetometer 40 of the magnetometer tool 38 may detect both the magnitude and the direction of the magnetic field 60 along three axes. The magnitude and direction of the magnetic field 60 may be used to estimate the direction and distance of the BHA 26 in the second well 14 relative to the first well 12. Having determined the estimated direction and distance from the first well 12, the BHA 26 may be controlled using this information to drill the second well 14 at an approximately constant separation distance 62 from the first well 12. For example, the precision available with magnetic ranging while drilling may permit the approximately constant separation distance 62 to approach five meters (5 m) with a variance of approximately one meter (1 m).

Figure 3:
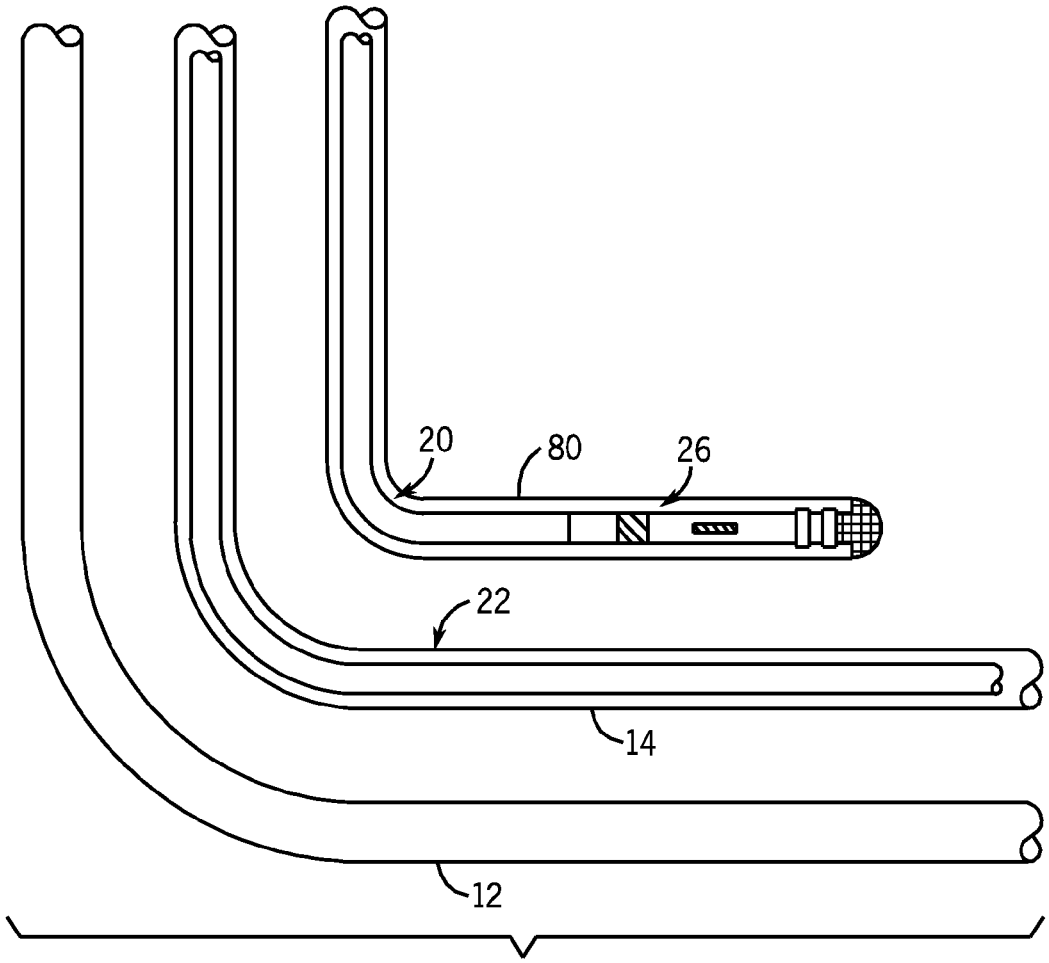
FIG. 3 is a schematic diagram depicting a second phase of the well drilling operation of FIG. 1.

The well drilling operation 10 represented in FIGS. 1 and 2 may depict an initial phase of a well drilling operation involving drilling multiple parallel wells using a magnetic ranging while drilling technique in accordance with present embodiments. A second phase in such an operation is illustrated in FIG. 3, which depicts a third well 80 being drilled in a parallel orientation with respect to the second well 14. Additionally, FIG. 3 may illustrate that multiple wells may be drilled in their respective positions using limited amounts of drilling equipment. Indeed, a well drilling operation such as that illustrated in FIG. 3 may be achieved using only two sets of drilling equipment in accordance with present embodiments.

In the drilling operation illustrated in FIG. 3, once the second well 14 reached its total desired depth, the first drill string 20 was recovered from the first well 12, while the second drill string 22 was left in the second well 14. In the illustrated embodiment, the first drill string 20 is being utilized to drill the third well 80 using magnetic ranging while drilling. Specifically, the BHA 26 initially used to drill the first well 12, which includes features configured to perform magnetic ranging while drilling as discussed above, is being utilized to position the third well 80 in a specific orientation with respect to the second drill string 22 residing in the second well 14. As would be understood by one of ordinary skill in the art, this process may be repeated numerous times to drill multiple wells relatively positioned with respect to one another in a formation. It should be noted that a retrievable MWD tool may be used. For example, a retrievable MWD tool may be utilized to drill the first well 12, and the MWD tool could be removed after the first well 12 reached a total depth.

Several wells may be ranged from a single well in accordance with present embodiments. For example, multiple wells may be drilled in a circular pattern around an initial well with a drill string residing therein. Additionally, in some cases, it may be desirable to drill wells close enough together such that several wells in a particular direction with respect to an initial well may be ranged from the initial well.

Figure 4:
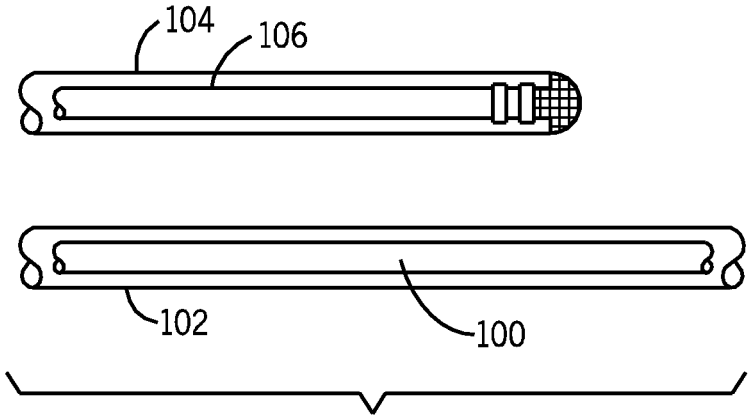
FIGS. 4 and 5 illustrate a potential sequence of drilling multiple wells based on a single initial well in accordance with one embodiment of the invention.
Figure 5:
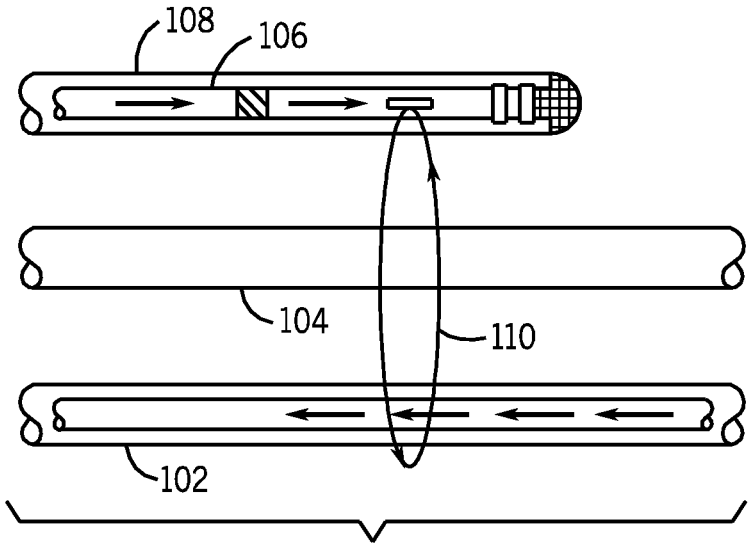

FIGS. 4 and 5 illustrate a potential sequence of drilling multiple wells based on a single initial well in accordance with present embodiments. Specifically, FIG. 4 illustrates a drill string 100 that has been left in a first well 102 that is openhole to facilitate positioning a second well 104 relative to the first well 102 using magnetic ranging while drilling. In FIG. 5, drill string 106, which was used to drill the second well 104, has been removed from the second well 104, which is also openhole, and is being used to drill a third well 108. As illustrated in FIG. 5, the third well 108 is a greater distance from the first well 102 than is the second well 104. Additionally, the second well 104 is positioned between the third well 108 and the first well 102. However, because the second well 104 is an openhole well without a conductive string in place, it does not interfere with magnetic ranging measurements. Accordingly, while a secondary magnetic field 110 may be weaker in such a situation, it may still be sufficient to perform magnetic ranging while drilling depending on the distances involved. It should also be noted that, in accordance with present embodiments, the third well 108 could have been drilled on the other side of the first well 102, and hence closer to the target drill string 100 left in the first well 102. Also, it should be noted that the relative positioning of the wells is not restricted to a two dimensional plane, but may involve three dimensional arrangements of wells in accordance with present techniques.

Figure 6:
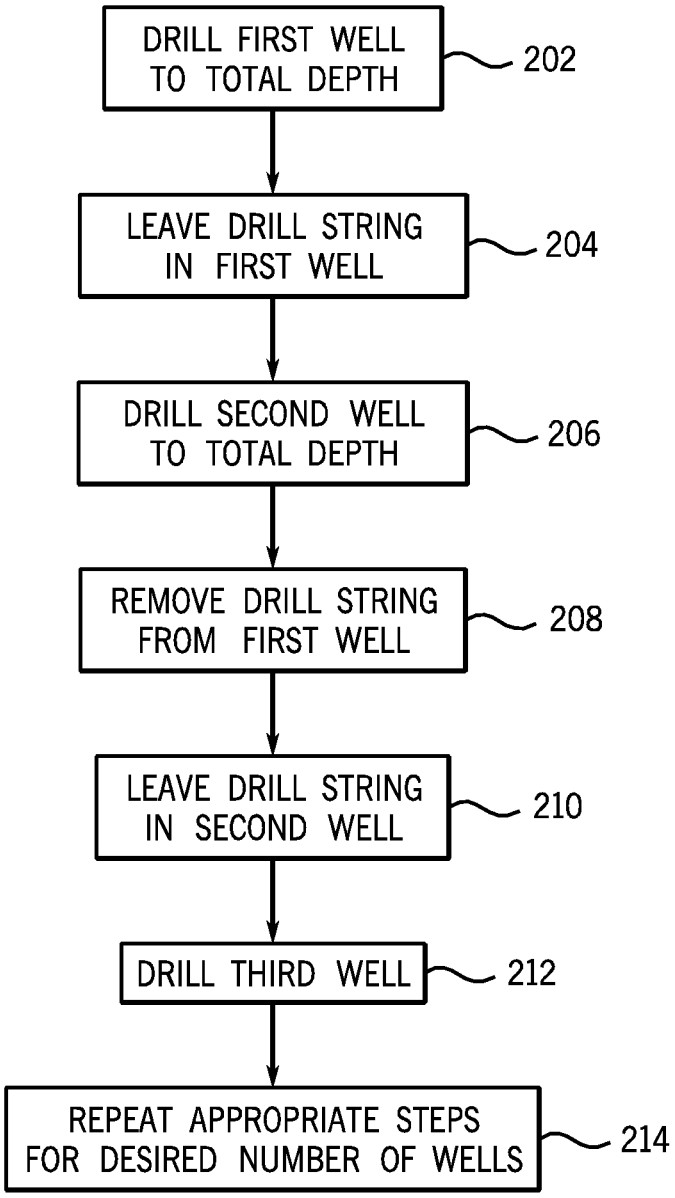
FIG. 6 is a flowchart describing a method of drilling relatively positioned wells in accordance with one embodiment of the invention.

FIG. 6 depicts a flow chart 200 for magnetic ranging while drilling for multiple wells in accordance with present embodiments. In step 202 a first well is drilled to a total depth with respect to the geology of a formation. In step 204, the drill string (e.g., including drill pipe or coiled tubing) utilized to drill the first well is left in the first well. Additionally, in step 204, the drilling rig utilized to drill the first well may be left attached to the drill string, or the drill string may be disconnected from the drilling rig. In step 206, a second well is drilled to a total depth using magnetic ranging will drilling to establish proper orientation, distance and direction of the second well with respect to the first well. If the drill string was disconnected from the drilling rig used to drill the first well, the same drilling rig may be utilized to drill the second well. In step 208, the drill string is removed from the first well. In step 210, the drill string utilized to drill the second well is left in the second well. Additionally, in step 210, the drilling rig utilized to drill the second well may be left attached to the drill string, or the drill string may be disconnected from the drilling rig. In step 212, a third well is drilled using magnetic ranging while drilling to establish proper orientation, distance and direction of the third well with respect to the drill string in the second well. This process may be repeated until a target number of wells have been drilled, as illustrated by step 214. For example, if a total of four wells are to be drilled, the drill string utilized to drill the third well may be left in place while a fourth well is drilled using magnetic ranging to properly position the fourth well with respect to the drill string residing in the third well.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A method of drilling a plurality of wells, comprising:

drilling a first well to a target depth with a first drill string without a casing;

leaving the first drill string in the first well and exciting a current in the first drill string downhole on an outer drill collar;

drilling a second well with a second drill string configured for magnetic ranging while drilling and exciting a current in the second drill string, wherein drilling the second well comprises using the first drill string as a target for magnetic ranging while drilling such that the second well is positioned with a specified orientation relative to the first well;

leaving the second drill string in the second well;

drilling a third well using a drill string and a bottom hole assembly configured for magnetic ranging while drilling, wherein drilling the third well comprises using the second drill string as a target for magnetic ranging while drilling such that the third well is positioned with a specified orientation relative to the second well.

2. The method of claim 1, further comprising removing the first drill string from the first well, wherein the third well is drilled with at least a portion of the first drill string.

3. The method of claim 1, comprising removing the first drilling rig from the first well after the target depth is reached.

4. The method of claim 3, comprising using the first drilling rig for drilling the second well.

5. The method of claim 3, wherein the specified orientation is a distance setting.

6. The method of claim 3, wherein the specified orientation is a non-perpendicular angular orientation.

* * * * *